US005827091A

United States Patent [19]

Briski et al.

[11] Patent Number: 5,827,091

[45] Date of Patent: Oct. 27, 1998

[54] METHOD OF TRANSPORTING A WIRING HARNESS

[75] Inventors: Curt M. Briski, Westland; Mark S. Grant, Livonia, both of Mich.

[73] Assignee: Yazaki Corporation, Tokyo, Japan

[21] Appl. No.: 856,903

[22] Filed: May 15, 1997

Related U.S. Application Data

[63] Continuation of Ser. No. 549,971, Dec. 26, 1995, Pat. No. 5,681,185.

[51] Int. Cl.[6] ..... H01R 13/40

[52] U.S. Cl. ..... 439/594; 439/502

[58] Field of Search ..... 439/626, 374, 439/660, 929, 701, 138, 140, 594; 29/33 M, 564, 564.1, 755, 866; 206/701–702

[56] References Cited

U.S. PATENT DOCUMENTS 3,310,623 3/1967 Vaughan ..... 206/702
5,681,185 10/1997 Briski et al. ..... 439/626

*Primary Examiner*—Neil Abrams
*Assistant Examiner*—Eugene G. Byrd
*Attorney, Agent, or Firm*—Young & Basile, P.C.

[57] ABSTRACT

A method of preventing damage to the metal contacts of multiple contact connectors in wiring harnesses during shipment and preinstallation handling. The method comprises the steps of providing essentially identical connector bodies with complemental, multi-point mechanical interconnections so that the connector bodies can be segregated into pairs and releasably attached to one another in such a way that the connector body surfaces relative to which the metal contacts are most exposed are juxtaposed relative to one another. The mated connectors and the associated wiring harnesses are thereafter packaged and shipped to a location where they are assembled into the vehicle. The mated connector pairs are detached from one another so that they may be separately routed in the course of the installation process. The apparatus disclosed provides means for releasably attaching the connectors to one another in juxtaposed pairs with multi-point mechanical connections which resist torsional loads found to occur during shipment and handling. The mating connector designs may be such as to be compatible with vehicle components used in the final installation.

4 Claims, 4 Drawing Sheets

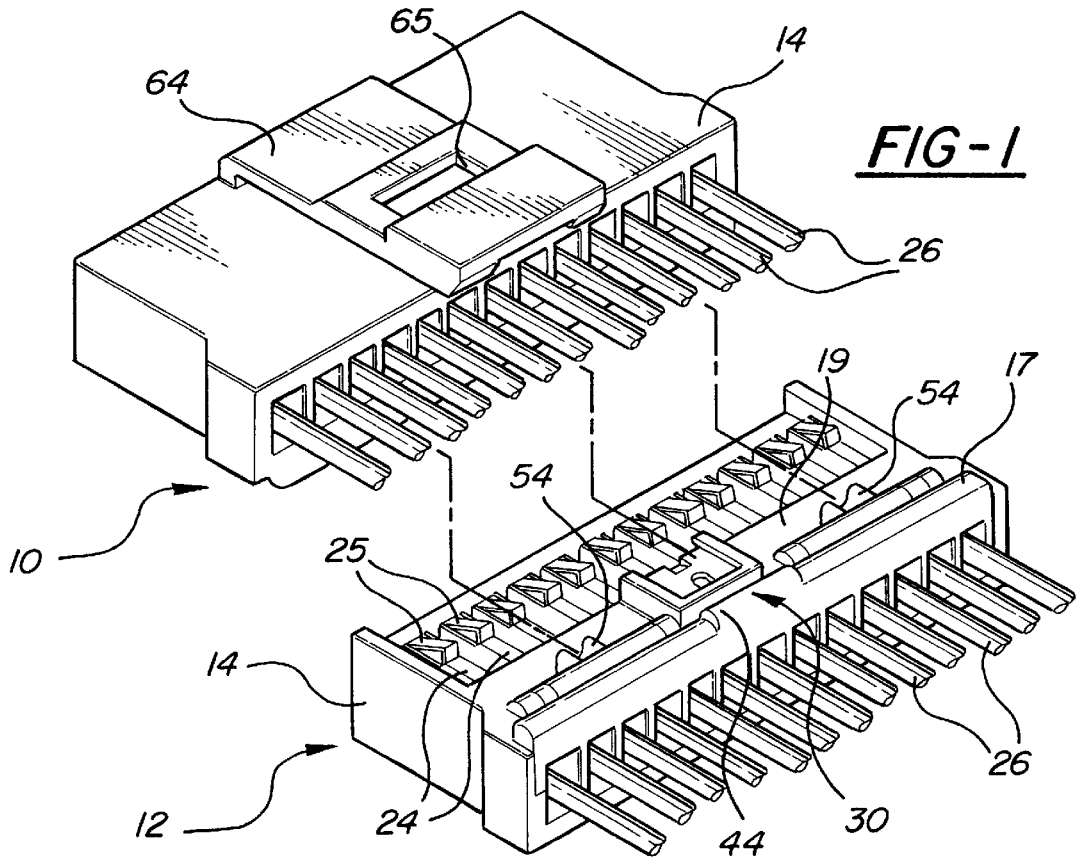
FIG-1
FIG-2
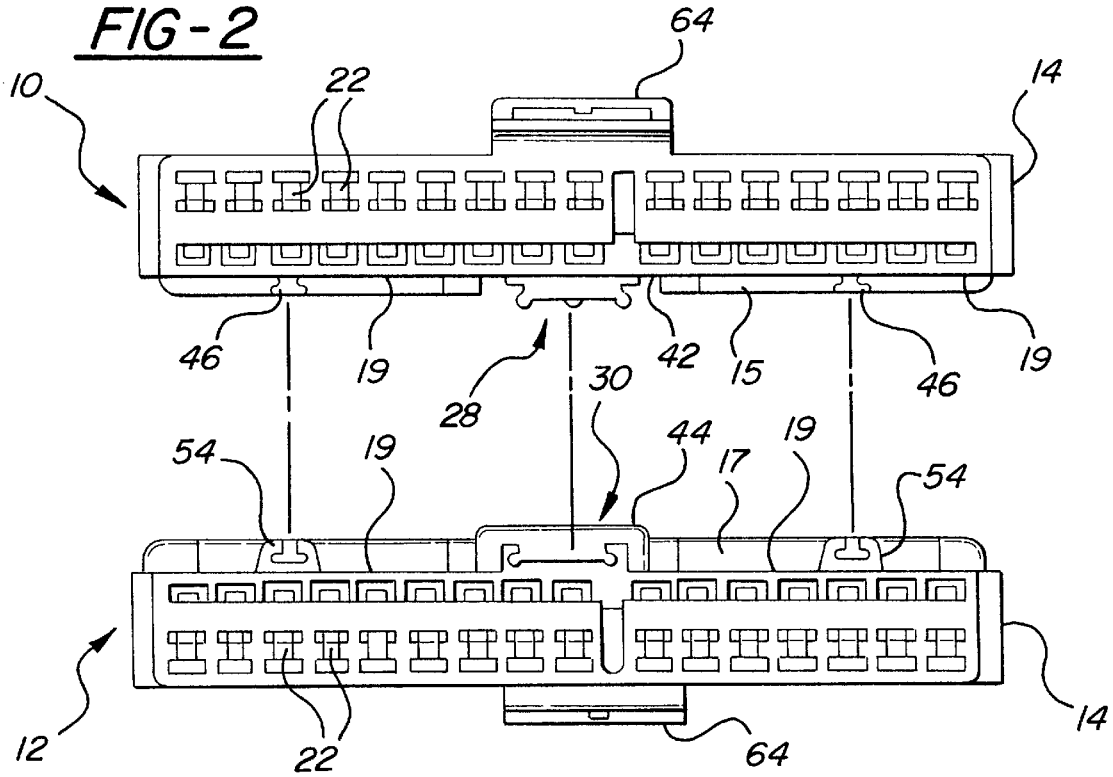

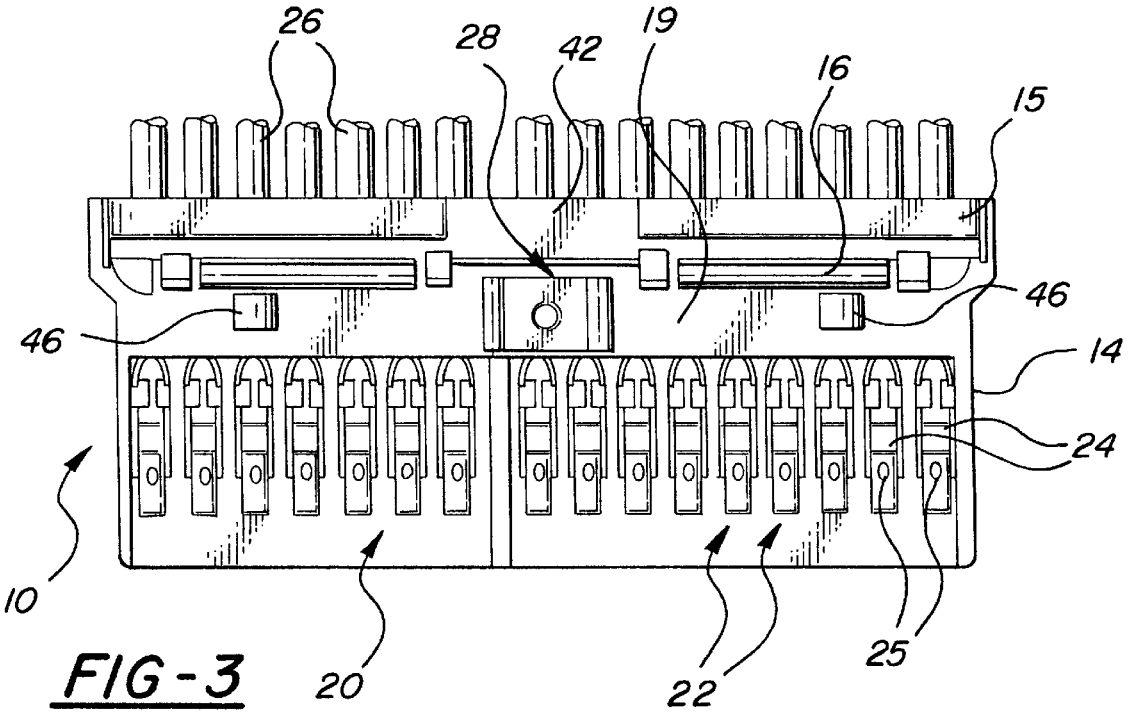
FIG-3
FIG-4
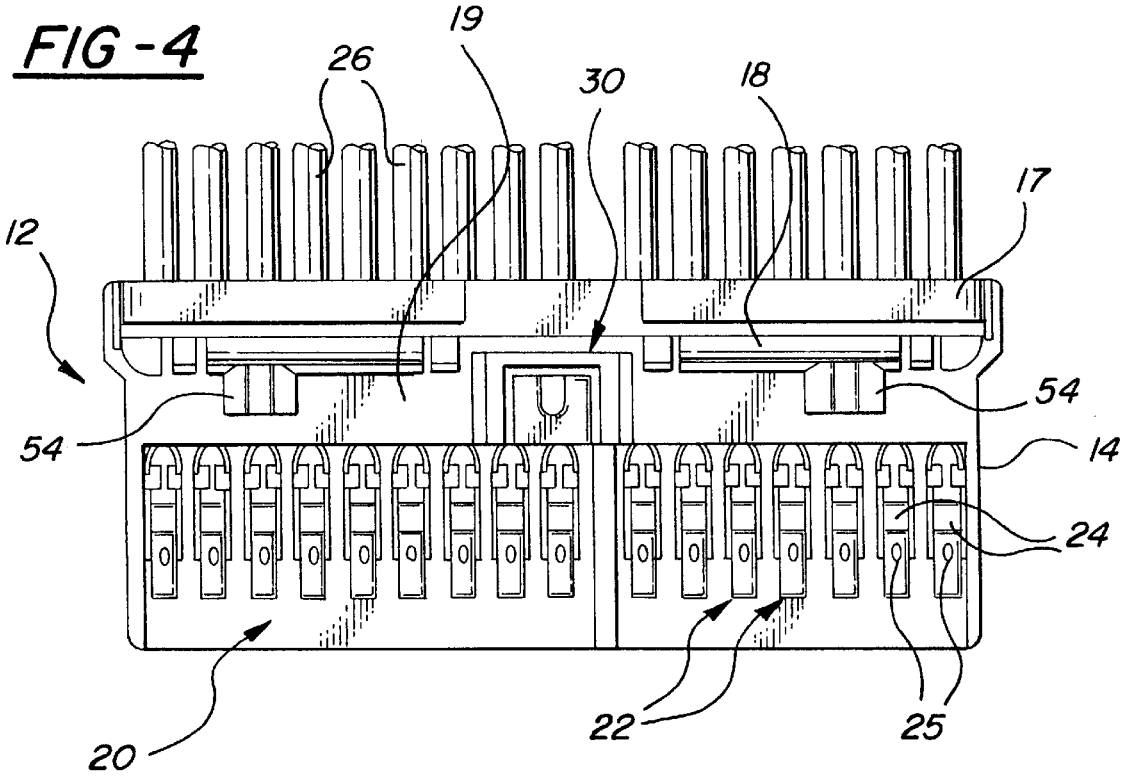

METHOD OF TRANSPORTING A WIRING HARNESS

This is a continuation of application Ser. No. 08/549,971 filed on Dec. 26, 1995 now U.S. Pat. No. 5,681,185.

FIELD OF THE INVENTION

The present invention relates to a mating mechanism for joining a pair of connectors to prevent movement of the connectors relative to one another during shipment and handling.

BACKGROUND OF THE INVENTION

Wiring harnesses are commonly used in automobile manufacture to electrically interconnect various components and systems of the vehicle. These wiring harnesses include a bundle of conductors which terminate in a variety of different connectors which mate with corresponding connectors on the vehicle components. Wiring harnesses are typically constructed at a location which is remote from the vehicle assembly point, this necessitating the packaging and shipment of finished wiring harnesses from one place to another.

Certain connector designs are more susceptible to damage during shipment than others; i.e., a connector design having a large open area in the connector housing which exposes a substantial portion of the electrical contact surface of the connector terminals is particularly susceptible to damage.

Connectors having exposed contact surfaces are frequently used when mating with a component having a flexible printed circuit. Previous attempts to protect connectors with exposed contact surfaces have included the use of a detachable and disposable cover which is mounted to the connector during wiring harness assembly. The cover surrounds and protects the contact surfaces during shipping and handling, and is removed and discarded at the vehicle assembly location. This practice generates a waste disposal problem and adds to the overall cost of the connector.

Another attempt to protect the electrical contact surfaces of a connector is disclosed in U.S. Pat. No. 5,051,100. That connector design includes a sliding cover which opens when the wiring harness connector is mated to the corresponding connector on the vehicle component. However, after the wiring harness and connectors have been installed in the vehicle, the sliding cover is no longer necessary. Therefore, the cover represents an additional cost in manufacturing the connector and adds to the complexity of the connector as well as to connector cost.

More recently, it was determined that the exposed metal contacts or terminals of a connector could be protected in shipment by temporarily mating the connector bodies to one another in pairs such that the face of one connector body is juxtaposed adjacent the face of another substantially identical connector body, the juxtaposed faces being those in which the metal contacts are most exposed. The connectors are detached from one another at or near the time and place of installation to permit them to be separately routed when installed in the vehicle. There is, in the arrangement, nothing to discard.

The latter approach, while generally satisfactory, involved the use of a single-point mating connection between the connector bodies. This single-point mating connection does not resist torsional loads which, it has been discovered, occur frequently in shipment and handling. Consequently the mated connector bodies often come apart prematurely.

SUMMARY OF THE INVENTION

The present invention solves the above-identified problems by providing a wiring harness shipping method and apparatus by which it is possible to effectively protect the exposed contact portions of connector bodies in a multiple-conductor, multiple-connector wiring harness without requiring a disposable protective cover, sliding cover or the like, and which is durable enough to withstand the torsional loads which have been found to occur in wiring harness packaging, shipment and handling. In general, the method invention comprises the steps of (1) providing a multiple-conductor wiring harness with multiple-conductor terminating connectors, the bodies of which have faces in which internally-mounted metal contacts are substantially exposed, (2) arranging the connector bodies in pairs, (3) establishing multi-point mechanical interconnections between the connector bodies by juxtaposing the aforesaid faces, (4) transporting the harness to the installation site, and (5) thereafter disconnecting the juxtaposed connector bodies from one another for installation in a vehicle.

The structure of the invention is such as to prevent movement of a pair of juxtaposed connectors relative to one another during shipping and handling of the connectors by providing means by which a multi-point mechanical connection between the connector bodies is established. Such a mating mechanism resists linear forces as well as rotational forces which are applied to the connectors.

In a preferred form, the apparatus invention includes a first connector and a second connector, each comprising a body or housing of plastic with a substantially planar mating surface. Complemental multi-point mating elements are located on the mating surfaces of the connector bodies which permits the surfaces having exposed contacts to be juxtaposed and releasably locked together for shipment. In one illustrative embodiment, a pair of retaining ribs extend from the first connector mating surface in a spaced apart relationship. A pair of retaining channels located on the second connector mating surface are spaced apart from one another and adapted to receive the retaining ribs of the first connector.

According to another aspect of the present invention, the first mating element includes a lock projection which engages a retaining cavity in the second mating element to secure the two mating elements together, and thereby secure the first and second connectors in a locked relationship. The first mating element further includes a pair of support structures extending from a body portion and supporting a pair of cylindrical rails. The second mating element includes a pair of cylindrical channels which are adapted to receive the cylindrical rails of the first mating element.

The first connector further includes a hinged rear holder which includes a notch. The second connector also includes a hinged rear holder having an outwardly extending projection which aligns with the notch in the rear holder of the first connector when the connectors are mated to one another.

According to another feature of the apparatus invention, each retaining rib includes a pair of opposite side walls with an expanded portion extending outwardly from each side wall. The expanded portions are continuous with the side walls and have an arcuate shape. The retaining channels include a pair of spaced apart side walls and a pair of arcuate inner surfaces which create an enlarged portion in the channel. The arcuate inner surface of the retaining channel is adapted to receive the arcuate expanded portion of the retaining ribs.

In an alternate embodiment, the first connector includes a first retaining rib extending from the mating connector surface and a first retaining channel extending from the connector mating surface. The second connector also includes a single rib and a single channel extending from the connector mating surface. The retaining rib and retaining channel on the first connector is positioned to align with the corresponding retaining channel and retaining rib on the second connector.

BRIEF DESCRIPTION OF THE DRAWINGS

FIG. 1 is a perspective view showing a pair of connectors prior to joining which contain the inventive mating structure;

FIG. 2 is a front elevational view of the pair of connectors prior to joining;

FIG. 3 is a top view of the first connector;

FIG. 4 is a top view of the second connector;

DETAILED DESCRIPTION OF THE PREFERRED EMBODIMENT

Figure 5:
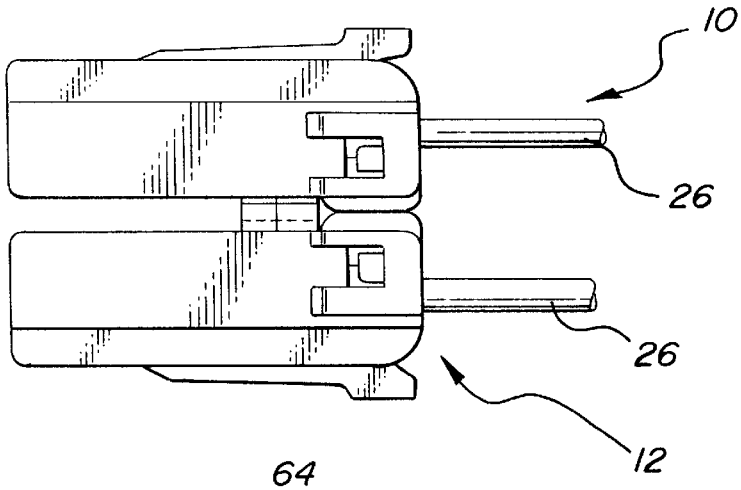
FIG. 5 is a side elevational view of the pair of connectors after joining.

FIGS. 1–4 illustrate a first connector 10 and a second connector 12 in a separated condition. Connectors 10 and 12 are substantially identical to one another, the exceptions lying in appendages which permit connectors 10 and 12 to be identified as a pair and releasably attached to one another as hereinafter described. Both connectors 10 and 12 include a non-conductive, plastic body 14 of essentially rectangular shape. A locking arm 64 is attached to body 14 to extend substantially parallel with the surface of the body, and a hole 65 passes through the locking arm. Connector 10 includes a hinged rear holder 15 which pivots about integral hinge 16. Hinge 16 permits rear holder 15 to pivot between a closed position and an open position for installation of metal contacts 24 as hereinafter described. FIG. 1 illustrates rear holder 15 in the closed position. Rear holder 15 on connector 10 includes a notch 42 located near the middle of the rear holder.

Connector 12 includes a rear holder 17 which is pivotally secured to the connector by using integral hinge 18. Rear holder 17 is pivotable between an open position and a closed position, similar to that of rear holder 15. Rear holder 17 on connector 12 includes a projection 44 extending outwardly from the middle of the rear holder. Notch 42 on rear holder 15 and projection 44 on rear holder 17 are positioned such that the projection aligns with the notch when connectors 10 and 12 are mated together. Therefore, no obstruction results from projection 44 in rear holder 17.

Referring to FIGS. 3 and 4, each of connectors 10 and 12 includes a substantially planar surface 19 proximate rear holders 15, 17. Both connectors 10 and 12 also have an open portion 20 in the connector body 14 proximate the forward end thereof. Open portion 20 is located adjacent mating surface 19 on the same side of the connector.

A plurality of terminal slots 22 are located in both connectors 10 and 12. Terminal slots 22 are arranged parallel to one another and extend through body 14 from front to back. A plurality of electrical terminals 24 are inserted into terminal slots 22 from the back of the connector. Rear holder 15 or 17 must be in the open position to permit insertion of terminals 24 into terminal slots 22. After terminals 24 are inserted into the connector, the rear holder is pivoted from the open position to the closed and latched position, thereby securing the terminals within the connector.

Each terminal 24 has a wire 26 attached at one end which may be bundled together to form a wiring harness (not shown). When terminals 24 are fully inserted into slots 22, a resilient electrical contact portion 25 of each terminal is exposed by open portion 20 in body 14. Therefore, contact portion 25 is unprotected and susceptible to damage during shipping and handling.

To form the first part of a multi-point interconnection for connector bodies 10 and 12, a first mating element 28 is positioned centrally along mating surface 19 on connector 10. A second mating element 30 is disposed centrally along mating surface 19 of connector 12.

Figure 8:
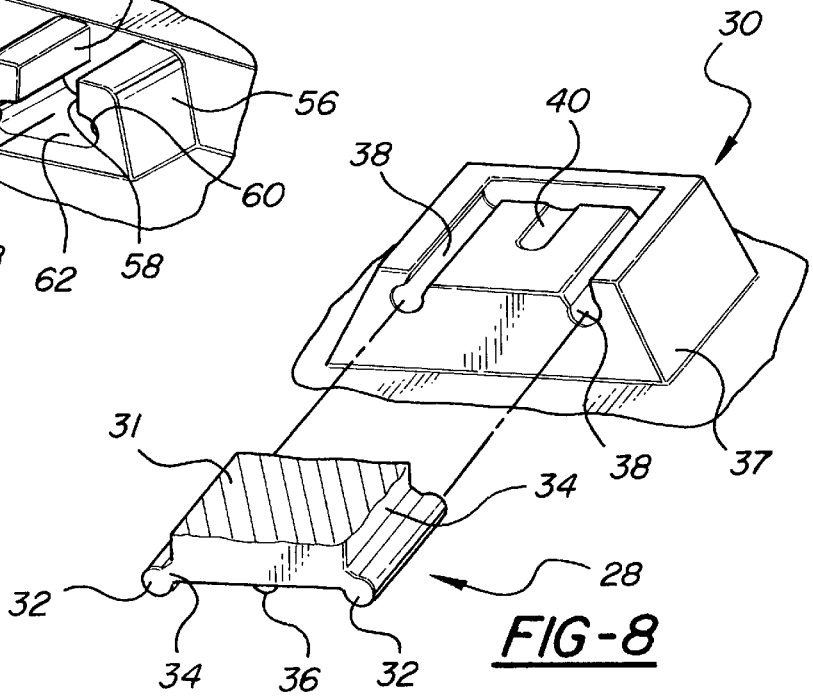
FIG. 8 is a partial view showing the details of the mating elements located near the center of each connector.

As shown in FIG. 8, first mating element 28 includes a body portion 31 having a pair of support structures 34 extending downwardly and outwardly from the body portion. A cylindrical rail 32 is located at the distal end of each support structure 34. Cylindrical rails 32 are arranged in a substantially parallel manner. A lock projection 36 extends perpendicularly from body portion 31 of first mating element 28 at a position approximately midway between cylindrical rails 32.

Second mating element 30 includes a body portion 37 having a pair of parallel, cylindrical channels 38 extending into the body portion, as illustrated in FIG. 8. The size, shape, and positioning of cylindrical channels 38 are complementary to cylindrical rails 32 and corresponding support structure 34 of first mating element 38, such that cylindrical rails 32 and support structures 34 slide into cylindrical channels 38 when elements 28, 30 are aligned with one another as shown in FIG. 8 and urged into engagement. Second mating element 30 further includes a retaining cavity 40 which aligns with and receives lock projection 36 when mating elements 28 and 30 are mated together. After cylindrical rails 32 begin to slide into channels 38, lock projection 36 contacts body 37 between channels 38. Further urging of mating elements 28, 30 toward engagement causes lock projection 36 to deflect upward sufficiently to slide over the upper surface of body 37 until the lock projection reaches retaining cavity 40 and snaps downward into detented engagement therewith. This interaction between lock projection 36 and retaining cavity 40 maintains mating elements 28, 30 securely together.

Referring again to FIG. 2, the preferred embodiment of the present invention includes a pair of retaining ribs 46 extending outwardly from mating surface 19 of first connector 10. A pair of corresponding retaining channels 54 are formed on mating surface 19 of second connector 12. Retaining ribs 46 and retaining channels 54 are registrable with one another, such that when first mating element 28 engages second mating element 30, each retaining rib 46 is in alignment with a corresponding retaining channel 54.

Figure 7:
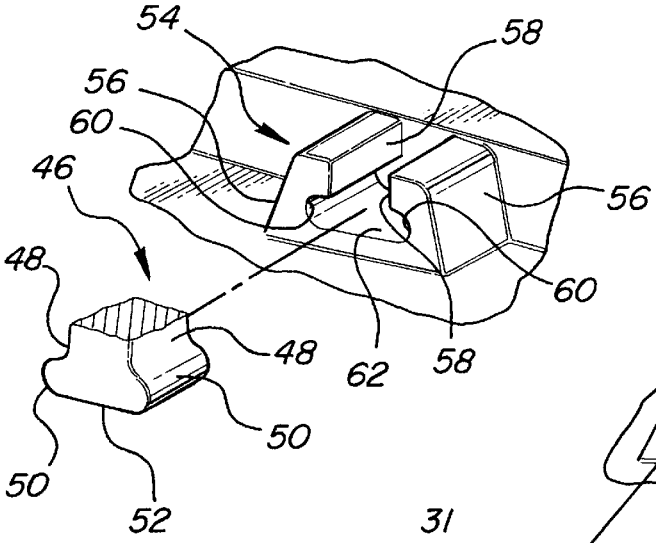
FIG. 7 is a partial view illustrating the details of a retaining rib and retaining channel for joining the pair of connectors.

FIG. 7 illustrates a detailed view of the complementary retaining rib 46 and retaining channel 54. Retaining rib 46 has a generally convex shape defined by a pair of flat side walls 48 spaced apart from one another and arranged in a substantially parallel relationship. Side walls 48 extend outwardly from and are continuous with mating surface 19 of first connector 10. A pair of expanded arcuate portions 50 are continuous with and extend outwardly from side walls 48. A flat planar surface 52 is located between expanded portions 50 and is continuous therewith.

Retaining channel 54 has a generally concave shape defined by a pair of support walls 56 extending outwardly from mating surface 19 of second connector 12. Support walls 56 include a pair of side walls 58 arranged in a parallel, spaced apart relationship. Support walls 56 further include a pair of arcuate inner surfaces 60, each being continuous with a side wall 58. A planar surface 62 is located between and continuous with both arcuate inner surfaces 60. As FIG. 7 illustrates, arcuate inner surfaces 60 create an enlarged portion of channel 54 and is dimensioned such that retaining rib 46 can slidably enter retaining channel 54.

Figure 10:
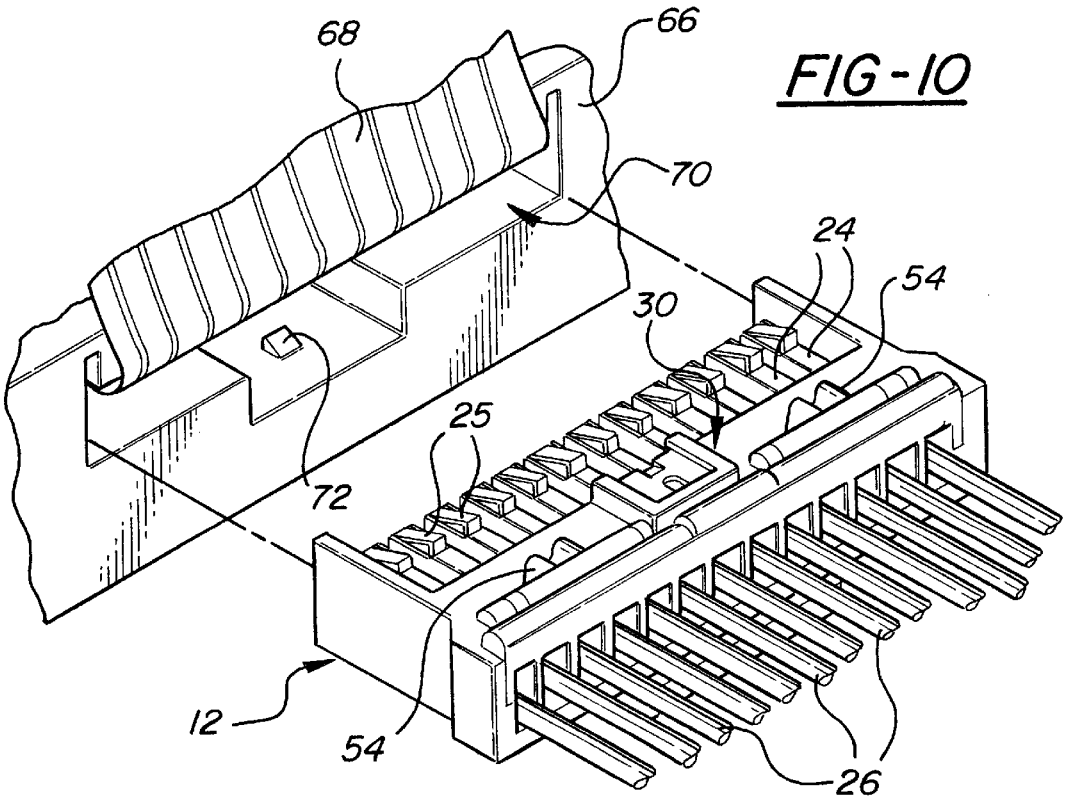
FIG. 10 is a perspective view of a single connector and a vehicle mating structure including a flexible printed circuit.

Referring to FIG. 10, each connector 10, 12 is matable with a mating receptacle 66 on a vehicle component. A flexible printed circuit 68 is secured to receptacle 66. An aperture 70 in receptacle 66 receives connector 10 or 12 such that flexible printed circuit 68 makes electrical contact with contact surfaces 25 of terminals 24. When connector 10, 12 is fully inserted into receptacle 66, a lock pawl 72 projecting into aperture 70 is in latching engagement with hole 65 in locking arm 64 to retain the connector in proper engagement. To remove connector 10, 12 from engagement with receptacle 66, locking arm 64 is pressed toward the surface of body 14 until lock pawl 72 is clear of hole 65, thus allowing the connector to be withdrawn from the connector. It would also be possible to design a mating receptacle 66 including structures similar to retaining ribs 46, retaining channels 54, and mating elements 28 and 30 positioned to operatively engage the existing connector mating structures (46, 54, 28 and 30) to secure the connector within the receptacle. Thus, the inventive mating structure may act to join connectors 10 and 12 during shipment as well as to secure the connectors to receptacle 66.

Figure 9:
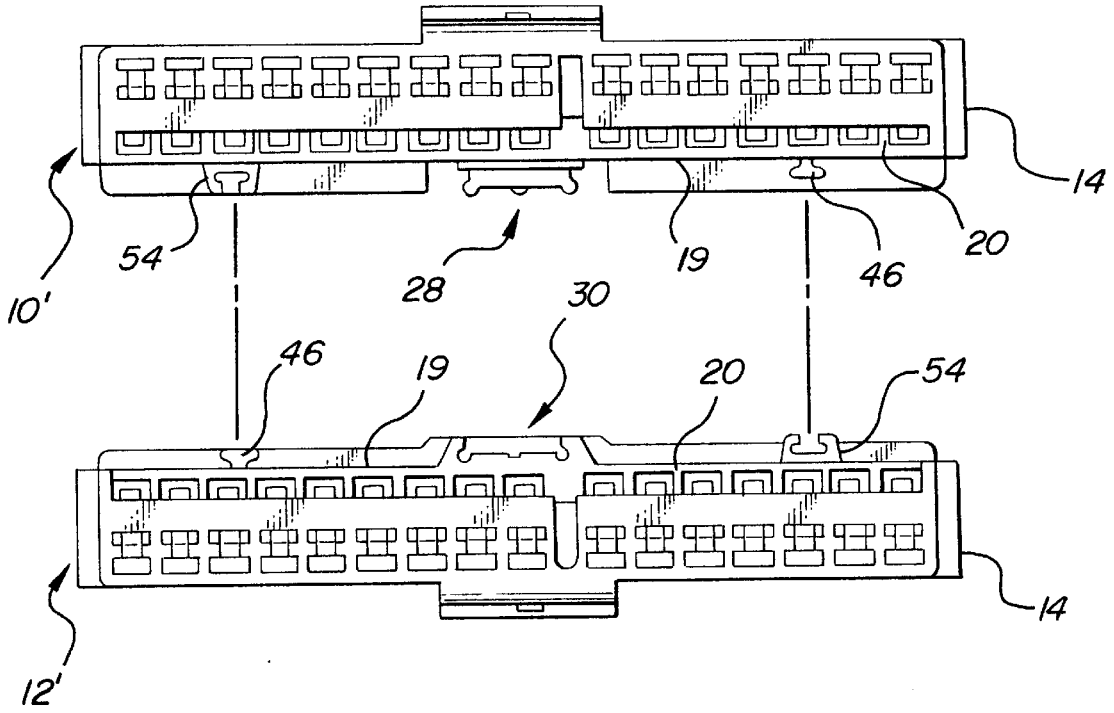
FIG. 9 illustrates an alternate embodiment of the present invention wherein the retaining ribs and retaining channels are arranged in a different manner.

FIG. 9 illustrates an alternate embodiment of the present invention. The alternate embodiment includes a pair of connectors 10', 12' each having an outer housing 14 and an open portion 20. First connector 10' includes a first mating element 28 and second connector 12' includes a second mating element 30. A retaining rib 46 and a retaining channel 54 are disposed on first connector mating surface 19 on opposite sides of first mating element 28. Similarly, a retaining rib 46 and a retaining channel 54 are disposed on second connector mating surface 19 on opposite sides of second mating element 30. Retaining rib 46 and retaining channel 54 on first connector 10' are registrable with the corresponding channel 54 and rib 46 on second connector 12' for mating the two connectors.

An additional embodiment of the present invention (not shown in the drawings) includes a pair of retaining channels 54 disposed on first connector 10 and a corresponding pair of retaining ribs 46 disposed on second connector 12. Except for the different arrangement of retaining ribs 46 and retaining channel 54, the remaining portions of connectors 10 and 12 are the same as described with respect to the above embodiments.

In operation, a wiring harness (not shown) is constructed which includes connectors 10 and 12 populated with terminals 24 and corresponding wires 26 (as shown in FIG. 1). After all terminals 24 and wires 26 are inserted into the connectors, hinged rear holders 15 and 17 are pivoted from the open position to the closed position, thereby securing the terminals within connector housing 14. Typically, this assembly step is performed at a wiring harness assembly facility.

Figure 6:
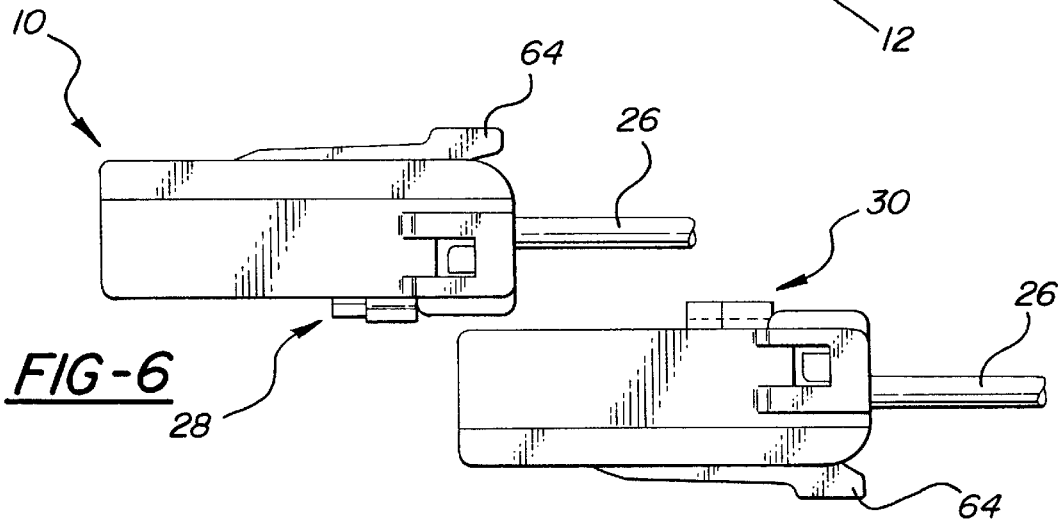
FIG. 6 is a side elevational view of the pair of connectors separated from one another.

Once both connectors 10 and 12 have been populated with terminals 24, the two connectors are identified as a complemental pair and are mated by juxtaposing the mating surfaces 25 of the connectors as shown in FIG. 1. In the juxtaposed relationship, electrical contact surfaces 25 are facing one another. As shown in FIG. 6, all wires 26 are routed in the same direction, and mating elements 28, 30 as well as retaining ribs 46 and retaining channels 54 are facing one another.

As connectors 10 and 12 are moved toward one another, first mating element 28 engages second mating element 30 while, at the same time, retaining ribs 46 engage retaining channels 54. When connectors 10 and 12 are mated together, lock projection 36 extending from first mating element 28 detentingly engages retaining cavity 40, thereby securing the two connectors together. The interaction between lock projection 36 and retaining cavity 40 prevents the two connectors from inadvertently separating from one another during subsequent shipping and handling. Additionally, retaining ribs 46 and retaining channels 54 prevent the connectors from rotating due to torque forces applied to the connectors.

As shown in FIG. 6, when connectors 10 and 12 are mated together, electrical contact portions 25 confront one another and are therefore protected by the opposing connector. Since the opposing connector protects the electrical contact portions 25, no protective housing or covering device is required. Thus, when the wiring harness arrives at the vehicle assembly location and the connectors 10 and 12 are ready for installation into the vehicle, the two connectors are simply separated from one another and mated to the corresponding vehicle component.

To separate connectors 10 and 12, the connectors are urged in the opposite direction from that used to mate the connectors. To release the connectors, a sufficient force is required to overcome the engagement between lock projection 36 and retaining cavity 40. Once that interaction is overcome, rails 32 on first mating element 28 slide out of channels 38 on second mating element 30. Similarly, retaining ribs 46 slide out of retaining channels 54.

As shown in FIG. 10, after connectors 10 and 12 have been separated, either connector may then be mated to a complementary electrical connector such as receptacle 66, thereby making electrical contact with flexible printed circuit 68.

The alternate embodiment of FIG. 9 operates in a manner similar to that described above with reference to the preferred embodiment. The differences illustrated in FIG. 9 are in the arrangement of retaining ribs 46 and retaining channels 54. The interactions of the mating structures are similar to the interactions in the preferred embodiment.

Although particular embodiments of the invention have been described as used with a particular type of connector, it will be understood that the inventive concepts contained in the present invention are applicable to a variety of different connectors used in a variety of applications.

We claim:

1. A method of transporting a multiple conductor wiring harness having at least two multiple conductor-terminating connectors, each connector comprising a connector body having a surface at which a plurality of metal contacts are substantially exposed, the method comprising the steps of:

(a) arranging a pair of said connectors with said surfaces in juxtaposed relationship;

(b) establishing multi-point mechanical interconnection between the connector bodies of said juxtaposed pair;

(c) transporting the harness; and, thereafter (d) disconnecting the juxtaposed connector bodies from one another so that each connector can be mated with a corresponding electrical component.

2. The method of claim 1 wherein when said surfaces are in said juxtaposed relationship said metal contacts are substantially protected from damaging contact with other objects without the need for disposable protective cover means.

3. A method of transporting a multiple conductor wiring harness having at least two multiple conductor-terminating connectors, each connector comprising a connector body having a surface at which a plurality of metal contacts are substantially exposed, the method comprising the steps of:

(a) arranging a pair of said connectors with said surfaces in juxtaposed relationship;

(b) joining said connectors of said juxtaposed pair by establishing multi-point mechanical interconnection between said connector bodies such that relative rotation between said connectors is substantially inhibited;

(c) transporting the harness; and, thereafter (d) disconnecting the juxtaposed connector bodies from one another so that each connector can be mated with a corresponding electrical component.

4. A method of transporting a multiple conductor wiring harness having at least two multiple conductor-terminating connectors, each connector comprising a connector body having a surface at which a plurality of metal contacts are substantially exposed, the method comprising the steps of:

(a) arranging a pair of said connectors with said surfaces in juxtaposed relationship;

(b) establishing multi-point mechanical interconnection between the connectors of said juxtaposed pair by joining a first mating element disposed centrally on a first connector body of said pair with a second mating element disposed centrally on a second connector body of said pair, and joining at least one retaining rib disposed on said first connector body and extending outwardly therefrom with at least one retaining channel disposed on said second connector body;

(c) transporting the harness; and, thereafter (d) disconnecting the juxtaposed connectors from one another so that each connector can be mated with a corresponding electrical component.

* * * * *

UNITED STATES PATENT AND TRADEMARK OFFICE

CERTIFICATE OF CORRECTION

PATENT NO : 5,827,091

DATED : October 27, 1998

INVENTOR(S) : Curt M. Briski and Mark S. Grant

It is certified that error appears in the above-identified patent and that said Letters Patent is hereby corrected as shown below:

Please add the following new claims:

--5. The method of claim 3, wherein when said surfaces are in said juxtaposed relationship said metal contacts are substantially protected from damaging contact with other objects without the need for protective cover means. --

-- 6. The method of claim 4, wherein when said surfaces are in said juxtaposed relationship said metal contacts are substantially protected from damaging contact with other objects without the need for protective cover means.--

Column 1, line 22, change "this" to --thus--;

Column 1, line 48, delete "as well as to connector cost";

Column 1, line 59, change "the" to --this--;

Please delete column 2, line 28 through Column 3, line 7;

Column 3, line 12, change "joining" to --being joined--;

Column 3, line 15, change "joining" to --being joined--;

Column 3, line 19, change "joining" to --being joined--;

Column 3, line 38, change "exceptions lying in" to --exception being--;

Column 4, line 8, after "15" insert --(connector 10)--

Column 4, line 8, after "17" insert --(connector 12)--

Column 5, line 17, change "is" to --are--;

UNITED STATES PATENT AND TRADEMARK OFFICE

CERTIFICATE OF CORRECTION

PATENT NO : 5,827,091

DATED : October 27, 1998

INVENTOR(S) : Curt M. Briski and Mark S. Grant

It is certified that error appears in the above-identified patent and that said Letters Patent is hereby corrected as shown below:

Column 5, line 24, change "10, 12" to --10 or 12--;

Column 5, line 28, change "10, 12" to --10 or 12--;

Column 6, line 6, change "complemental" to --complementary--;

Column 7, line 10, delete "disposable";

In the Abstract, line 5, change "complemental" to --complementary--.

Signed and Sealed this

Tenth Day of August, 1999

*Attest:*

*Attesting Officer*

Q. TODD DICKINSON

*Acting Commissioner of Patents and Trademarks*